United States Patent [19]

Omae et al.

[11] Patent Number: 4,577,385

[45] Date of Patent: Mar. 25, 1986

[54] METHOD AND APPARATUS FOR REPAIRING A WALL OF COKE OVEN

[75] Inventors: Yoshihiro Omae; Kunio Ishikawa; Takahisa Fukao; Katsushige Yoshida, all of Kitakyushu, Japan

[73] Assignee: Mitsubishi Chemical Industries, Ltd., Tokyo, Japan

[21] Appl. No.: 496,511

[22] Filed: May 20, 1983

[30] Foreign Application Priority Data

May 27, 1982 [JP] Japan ..... 57-88895

[51] Int. Cl.[4] ..... B67D 5/08; B23K 9/04; B22D 19/10; B23P 7/00

[52] U.S. Cl. ..... 29/402.18; 239/71; 266/281

[58] Field of Search ..... 239/71, 73, 74; 266/281; 29/402.18

[56] References Cited

U.S. PATENT DOCUMENTS 1,431,763 10/1922 Service ..... 239/74
2,794,681 6/1957 Suess ..... 239/71
2,850,324 9/1958 Suess ..... 239/71
2,850,325 9/1958 Suess ..... 239/71
4,301,998 11/1981 Rodway ..... 239/71

*Primary Examiner*—Mark Rosenbaum
*Assistant Examiner*—Vernon K. Rising
*Attorney, Agent, or Firm*—Oblon, Fisher, Spivak, McClelland & Maier

[57] ABSTRACT

A method and apparatus for observing and/or repairing damages on a wall of a coke oven or combustion chamber is disclosed. The damages on the wall are detected by positioning a heat resisting lance which includes an optical system for observing an image on the wall and conduit having a nozzle for spraying repairing materials onto damaged areas on the wall in the inside of the coke oven and moving the lance horizontally and vertically within the coke oven along its wall while observing the image on the wall at an outside of the coke oven through the optical system. When the damages are detected, the damages are repaired by spraying the repairing material onto the damaged area on the wall from the nozzle.

14 Claims, 15 Drawing Figures

METHOD AND APPARATUS FOR REPAIRING A WALL OF COKE OVEN

BACKGROUND OF THE INVENTION

1. Field of the Invention

This invention relates to a method and apparatus for repairing damages on a wall of an enclosed chamber or structure in which a fuel is burned to provide heat, such as, for example, coke ovens or combustion chambers in a coke oven battery.

2. Description of the Prior Art

A coke oven is constructed at present chiefly by refractory bricks because it is subjected to an extremely high temperature. The coke oven undergoes external mechanical force, thermal stress and various other effects resulting from carbonization of coal charge, coke oven gas and the like. Therefore, damages are created at various parts of the coke oven when it is used for a long period of time. More particularly, a wall of the coke oven is liable to be damaged, because various effects resulting from the above factors are exerted to be concentrated on the wall. When the wall of the coke oven is damaged, the damage on the wall must be repaired by spraying mortar. If the wall is damaged to a large extent, the refractory bricks must be exchanged. In this regard, it is required to examine as to whether the wall of the coke oven or combustion chamber is damaged. Furthermore, the damaged area and its condition must be understood exactly.

In the prior art, the damaged area on the wall is detected by an operator peeping at the inside of the oven from a front of the coke oven or an inspection hole of the combustion chamber. In this method, it is not easy to detect the damaged area on the wall, its location and the condition of the damage exactly. Furthermore it is not desirable for a human operator to conduct the examination of the coke oven in under a hard working environment which is at a high temperature. Furthermore, when the damages are detected, the repairing work must be conducted in the inside of the coke oven covering a wall opposite to the wall to be repaired with a heat insulating material. Accordingly, the repairing work in the prior art is troublesome, takes time and is hazardous because it must be done under a high temperature and bad environment.

BRIEF SUMMARY OF THE INVENTION

Accordingly, it is an object of the present invention to provide a method of observing a wall of a coke oven or combustion chamber to detect damages on the wall at an outside of the coke oven or combustion chamber.

It is another object of the present invention to provide a method of repairing damages on a wall of a coke oven or combustion chamber quickly and reliably without entering into the inside of the coke oven or combustion chamber while observing the damages on the wall at an outside of the coke oven or combustion chamber.

It is still another object of the present invention to provide an apparatus for observing a wall of a coke oven or combustion chamber to detect damages on the wall at an outside of the coke oven or combustion chamber and/or repairing the damages on the wall quickly and reliably without entering into the inside of the coke oven or combustion chamber while observing the damages on the wall at an outside of the coke oven or combustion chamber.

Briefly, the foregoing and other objects are attained in accordance with an aspect of the present invention by providing a method of repairing damages on a wall of an enclosed chamber or structure in which a fuel is burned to provide heat, which method comprises the steps of inserting a lance into the inside of the enclosed chamber from a doorway of the enclosed chamber, said lance being provided with at least an optical system reflecting, forcussing and transmitting an image on the wall so as to observe at an outside of the enclosed chamber and a nozzle for spraying materials adapted for use in repairing the damages on the wall, detecting the damages on the walls by moving the lance horizontally and vertically within the enclosed chamber along the wall while observing the image on the wall through the optical system at the outside of the enclosed chamber, and spraying repairing material onto damaged areas detected on the wall from the nozzle.

According to another aspect of the present invention, there is provided an apparatus for repairing damages on a wall of an enclosed chamber in which a fuel is burned to provide heat comprising a heat resisting elongated cylindrical tube having an opening at the front end thereof, an optical system extending continuously within the tube and including a condensing portion provided at the front end of the tube and optical fibers for transmitting an image (image guide) reflected from the wall and forcussed by the condensing portion so as to observe at an outside of the enclosed chamber, and a conduit extending continuously within the tube and having a nozzle at the terminating end thereof for spraying materials adapted for use in repairing the damages on the wall.

BRIEF DESCRIPTION OF THE DRAWINGS

The exact nature of this invention, as well as other objects and advantages thereof, will be readily apparent from consideration of the following specification relating to the annexed drawings in which.

DETAILED DESCRIPTION OF THE PREFERRED EMBODIMENTS

Figure 1:
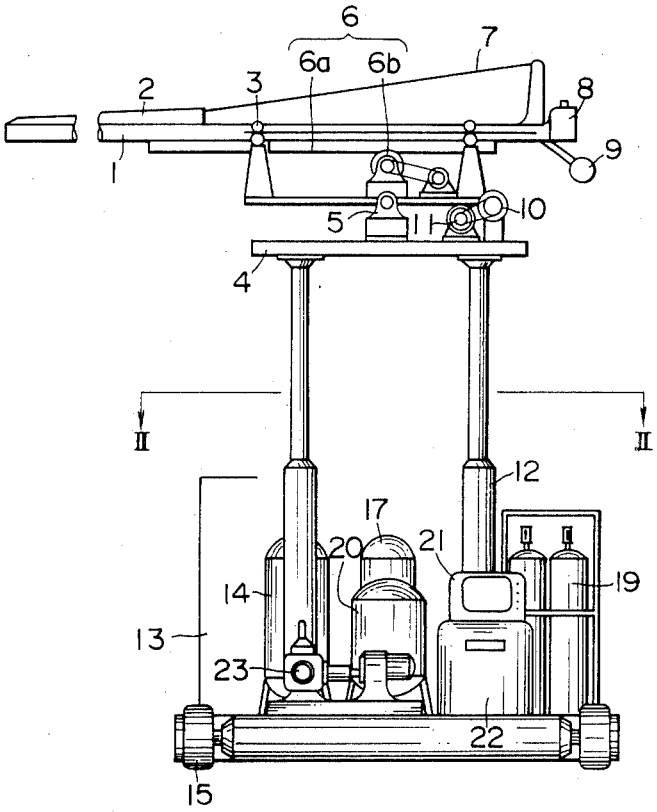
FIG. 1 shows a plan view of the entire apparatus adapted for use according to an embodiment of the present invention.
Figure 2:
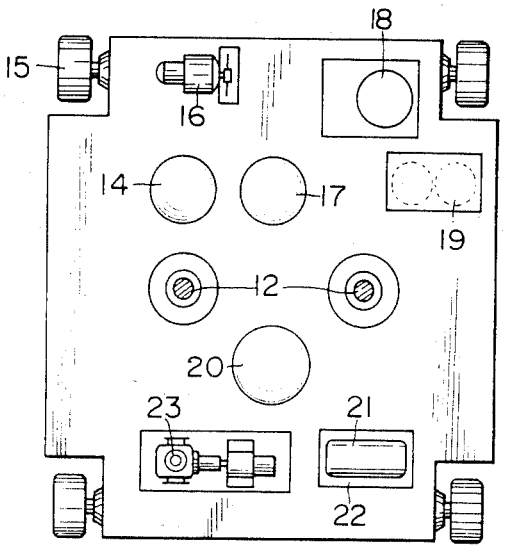
FIG. 2 is a cross-sectional view taken along the lines II—II of FIG. 1 looking in the direction of the arrow.
Figure 3:
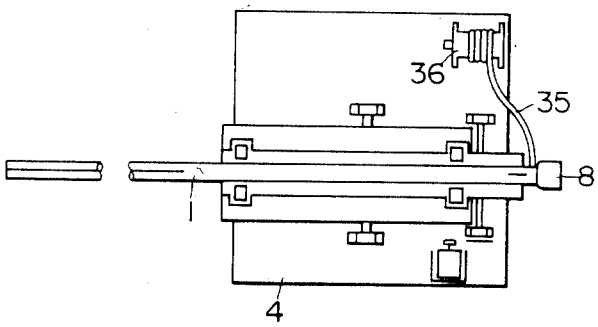
FIG. 3 is a diagrammatic top plan view of the apparatus shown in FIG. 1.

Referring now to the drawings, and particularly to FIGS. 1 through 3, there is illustrated an apparatus for detecting and/or repairing a damaged area on a wall of an enclosed chamber or structure in which heat is produced, as by burning fuel, for producing coke and the like. The apparatus includes a lance 1 for detecting and/or repairing the damages on the wall. The lance 1 is provided with a reinforcement rib 2 and wire 7 stretched above the lance 1. In addition, there are provided a rack 6*a* on the underside of the lance 1, a camera 8 and a balance weight 9 at the rear end of the lance 1. The lance 1 is movable on side rollers 3 in both forward and rearward directions by means of a pinion 6*b* which engages with the rack 6*a* and causes the lance to advance into the enclosed chamber, such as, for example, a coke oven or chamber, for detecting the damages on the wall. The lance 1 is axially supported on bearings 5 mounted on a platform 4 so as to be able to tilt by means of a gear 10 which is driven by a motor 11.

Reference numeral 12 denotes hydrauric cylinders which give up-and-down movement to the platform 4. The cylinders 12 are mounted on a truck which is propelled by means of wheels 15 to be driven by a motor 16. In addition, a heat shielding wall 13, an air tank 14, a cooling water tank 17, a feeder 18 of repairing materials, an oxygen bomb 19, an oil tank 20, a monitoring television receiver 21, and a control panel 22 are arranged on the truck as shown in FIGS. 1 and 2.

Figure 4:
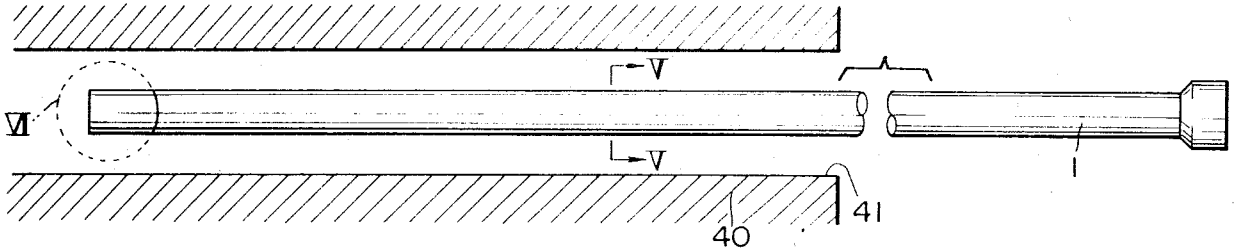
FIG. 4 is a diagrammatic and longitudinal plan view of a lance portion of the apparatus illustrating an arrangement of the lance into the interior of coke oven.
Figure 5:
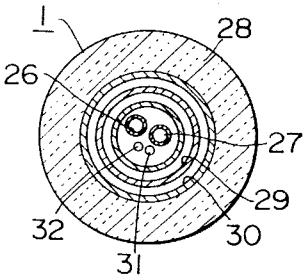
FIG. 5 is an expanded cross-sectional view taken along the lines V—V of FIG. 4.
Figure 6:
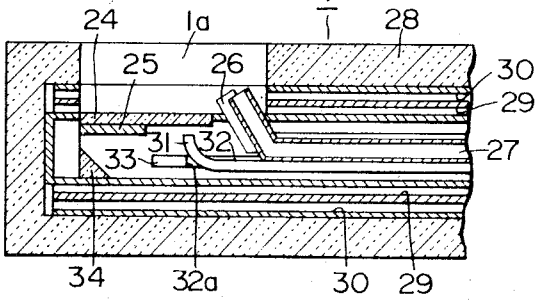
FIG. 6 is an expanded longitudinal sectional view of a front end of the lance.

The inside structure of the lance 1 is as shown in FIGS. 5 and 6. FIG. 5 shows the cross-sectional view of the lance 1 taken along the lines V—V of FIG. 4, whereas FIG. 6 shows the cross-sectional view of the muzzle or front end of the lance 1 corresponding to the portion which is encircled by the dotted-line VI in FIG. 4. As shown in FIGS. 5 and 6, the lance 1 includes a viewing window 24 made of quartz, an infrared absorption filter 25 attached to the rear surface of the window 24, a conduit 26 having a nozzle at the terminating end thereof which is directed to an opening 1*a* of the lance 1 for blowing air or oxygen gas and is connected to the air tank 14 or the oxygen bomb 19 by means of a valve, and a conduit 27 having a nozzle at the terminating end thereof which is directed to the opening 1*a* of the lance 1 for spraying discrete materials adapted for use in repairing the damages on the wall. These conduits 26 and 27 run continuously within the lance 1 from the rear end to the front end thereof. The lance 1 further includes a light guide 31 and an image guide 32 which are made of optical fiber bundles. The light and image guides 31 and 32 run continuously within the lance 1 in the same manner as the conduits 26 and 27, and the terminating end of the light guide 31 is directed toward the opening 1*a* of the lance 1 as shown in FIG. 6. The image guide 32 is provided with a lens 33 at the terminating end thereof which is directed oposite to a reflector 34. The outer shell of the lance 1 is made of a heat insulating material 28, and cooling system which comprises a cooling water supply pipe 29 and a cooling water recovery pipe 30 each connected to the cooling water tank 17 is provided to protect the optical system and conduits through which the fluids and discrete materials flow against heat.

In FIG. 3, reference numeral 35 designates a supply tube for the discrete material which is made of a flexible hose and the like and one end of the supply tube 35 is connected to the conduit 27. The supply tube 35 is wound around a drum 36 mounted on the platform 4 and the other end of the supply tube 35 is connected to the feeder 18 of repairing material. Thus, the supply tube 35 can be released from the winding on the drum 36 when the lance 1 is advanced to cause the supply tube 35 to pull. To the contrary, when the supply tube 35 becomes loose due to the retractive movement of the lance 1, the drum 36 rotates to wind up the loosened supply tube 35. The supply tube 35 extending from the drum 36 to the feeder 18 is not shown in FIG. 1, because it is located behind the control panel 22.

Reference will now be made to a repairing work of a coke oven using the apparatus which includes the structures as explained above. To begin with, the apparatus shown in FIG. 1 is moved by energizing the motor 16 for driving the wheels 15 so that it may be located in front of a front of either a coke side or pusher side of a coke oven to be examined. Then, the station 4 is subjected to up-and-down movement by means of the hydraulic cylinder 12 while adjusting inclination of the lance 1 by energizing the motor 11, thereby to maintain the lance 1 horizontally at a predetermined height. In the next place, the lance 1 is advanced by rotating the pinion 6*b* and introduced into the coke oven through the front as shown in FIG. 4 so that the opening 1*a* formed at the front end of the lance 1 may be directed to a wall 41 to be examined in the coke oven 40. The wall 41 is then exposed to light emitted from the terminating end of the light guide 31. The light reflected from the wall 41 passes through the viewing window 24 and the infrared absorption filter 25 and reaches the reflector 34. The reflector 34 reflects an image of the wall 41 and the image is focussed on an end surface 32*a* of the image guide 32 by means of the lens 33. The image formed on the end surface 32*a* of the image guide 32 is tranmsitted to the other end of the image guide 32 passing therethrough where it is taken as a photograph by the camera 8 or it is observed by means of the monitoring television receiver 21. Instead of the observation on the television, the image may be observed by means of an eyepiece. In this manner, the condition of the wall in the coke oven is observed from the outside of the coke oven so as to detect locations where the wall is damaged. This detection can be easily and quickly made.

When the damaged area on the wall is detected in the manner as explained hereinabove, the position of the lance 1 is adjusted so that the nozzle 27 may be directed to the exact location where the wall is damaged. Then, fine particulate materials contained in a feeder (not shown) are blasted from the nozzle 27 through the supply tube 35 by using compressed air, gas, liquid and the like so that the damaged area on the wall may be subjected to abrasion. After finishing the abrasion, the supply tube 35 is switched to be connected to the feeder 18 of repairing material, and the repairing material is sprayed from the same nozzle by using compressed air, gas or liquid and the like against the damaged area on the wall. Then, the repairing work of the damaged area on the wall is completed.

When repairing the damaged area on the wall, it is preferable to place the lens 33 and to direct the nozzle for spraying the repairing material in such relation that the direction of spraying the repairing material from the nozzle lies in the center of the position of observing the wall, because this makes it possible to spray the repairing material while observing the damaged area on the wall in the center of viewing range of the wall. As a result, the damaged area on the wall can be repaired exactly.

The fine particulate material adapted for use in sandblasting must have sufficient heat resistant property and hardness when it is in use, the example of which is corundum, emery, garnet, quartz sand, spinel, alumina, zirconia, silicon carbide, boron carbide, boron nitride, grit, shot and the like. The diameter of the particulate material used is 0.1 to 5 mm, preferably 0.3 to 3 mm. The blast of the fine particulate material is effected under such conditions that the ejection pressure from the nozzle is 2 to 20 $kg/cm^2.G$, preferably 3 to 10 $kg/cm^2.G$ and that the ejection velocity is 0.5 to 5 km/sec., preferably 1 to 2 km/sec. by adjusting the pressure of compressed fluid and the nozzle size orifice. The repairing materials are those which can be easily oxidized. When the repairing material is sprayed under molten state by combustion, either oxygen gas or air is spouted from the nozzle 26.

After finishing the repairing work of one damaged area on the wall, the lance 1 is advanced further in the coke oven to continue the observation and/or repair of the other damaged area on the wall. When the observation and/or repair of the damages at a certain height of the wall is completely finished, the platform 4 is shifted to a plane of different height by means of the hydraulic cylinder 12 to conduct the observation and/or repair of the damage on the wall at that height in the same manner as explained above. Then, the entire wall of the coke oven is observed and/or repaired.

The damage on the wall is mainly created at a joint of the brick. Accordingly, it is advantageous to actuate the hydraulic cylinder 12 and the pinion **6*b* so that the lens 33 of the lance 1** may travel along the joints by having locations of the joints memorized in a computer. This makes it possible to significantly reduce the time required for observing and/or repairing the wall.

In the above repairing work, the lance 1 is subjected to the forward and rearward and the up-and-down movements. The feeder 18 of the repairing material is fixed to the truck and does not move. Thus, the relative position of the lance 1 and the feeder 18 changes during the observing and/or repairing operation permitting the supply tube 35 which is flexible and connects the lance 1 to the feeder 18 to move the lance 1 freely. Futhermore, the drum 36 winding the supply tube 35 on the way prevents the supply tube from slacking and being an obstacle if the distance between the lance 1 and the feeder 18 becomes short and the supply tube becomes loose. On the other hand, the drum 36 permits the supply tube wound on the drum 36 to release without slacking when the lance 1 is advanced to make the distance between the lance 1 and the feeder 18 longer. Thus, there is no possibility that the slackened supply tube entangles the lance 1 to cause the movement of the lance to be checked, and the lance 1 can be moved smoothly.

In this embodiment, the cooling water supply pipe 29 and the cooling water recovery pipe 30 are arranged within the lance to protect the light guide 31, image guide 32 and the like against heat by circulating cooling water in the tank 17 through the cooling water supply pipe 29 and the cooling water recovery pipe 30. Thus, the lance 1 is not damaged if it is inserted into the high temperature coke oven.

It is difficult to discriminate between a brick and its joint in the coke oven if there is no significant difference in brilliance. In this instance, in order to make the discrimination easy, a surface to be observed is irradiated by light emitted from the light guide 31 or a light source (not shown) directly inserted into the coke oven, and the incident radiation in the infrared spectra entering into the image guide is absorbed in the filter 25. In a positive alternating method of making the discrimination easy, air is blown on the wall of the coke oven from the diagonal or front direction thereof through the nozzle for blowing the air or oxygen gas, thereby to make a brilliant different due to difference in temperature between the brick and the joint. If there is a crack in the joint, the difference in temperature between the brick and the joint becomes remarkable, which makes the discrimination easy. It is possible to use nitrogen gas as a fluid to be blown against the wall instead of the air. The air is preferable, because it makes the discrimination between the brick and the joint easy. Presumably, this is because temperature at the crack portion in the joint becomes higher due to combustion of carbon which is deposited on the crack portion in a higher rate. In addition to the air, oxygen gas or gases containing various concentration of oxygen can be used.

Generally, the height of lance mounted on the platform lies in a position which is higher than the bottom wall of coke oven in view of relation between the coke oven and service benches. Accordingly, it is impossible to observe and repair the damages on the wall which are created at a position lower than that of the lance to be located when the lance is descended to the lowermost according to the method of the observation and/or repair using the apparatus explained above. In this instance, the lance 1 is tilted from the horizontal position by rotating the gear 10 so as to effect the observation and/or the repair of the area which lies in the position lower than the lowermost position of the lance.

The lance 1 of the above embodiment includes an elongated cylindrical body which extends longitudinally within the coke oven to the center portion thereof when the lance is inserted into the coke oven from the doorway of either the coke side or pusher side of the coke oven. Thus, the entire length of the elongated lance must be moved when examining the wall in the coke oven.

Figure 7:
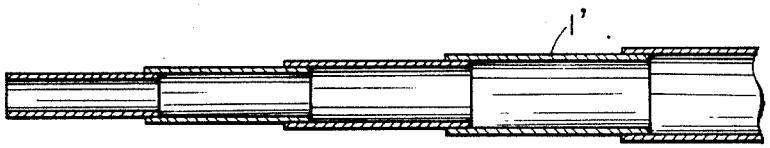
FIG. 7 is a longitudinal cross-sectional view of a modification of the lance according to the present invention.

FIG. 7 shows a lance 1' of telescopic structure which reduces its length and range for moving the entire lance within the coke oven and makes shifting of the lance at an outside of the coke oven easy. The detailed structure of this lance will be explained hereinafter with reference to FIGS. 8 through 13. In the lance of telescopic structure, it is not preferable that the conduit for supplying the air or oxygen gas and other pipes or tubes disposed within the lance are made of hard material, such as a metal. All of the tubes including the tubes for protecting the light guide or image guide and the gas supply tube connected to the air or oxygen gas spray nozzle are made of heat resisting flexible tubes. The flexible tubes are wound on a drum similar to the drum 36 shown in FIG. 3 which is mounted on the truck so that the flexible tubes may not be obstractive of the movements of the lance and the platform.

The method of observing and/or repairing the wall of the coke oven by inserting the lance into the coke oven from the doorway has been explained. It is a matter of course that the observation and/or repair of the wall of the coke oven can be effected by inserting the lance into the coke oven from the top of the oven through charging holes of the coke oven or inspection holes of a combustion chamber.

The method of spraying the repairing materials which is applicable to the method of the present invention includes a wet method which sprays particulate mortar while mixing with water, a thermal spraying method which sprays the particulate mortar under molten state being melted by a high temperature gas flame and a method of spraying the particulate mortar as it is. In addition to the mortar, a mixture of metal oxide and glass raw material powders, and a mixture of the metal oxide and glass raw material powders to which an additional metal powder is added can be used as a repairing material. As explained above, the spraying of these repairing materials is effected by the force of pressurized liquid, air or gas. If water is used as a liquid, the wet method can be achieved. If carrier gas is used, the thermal spray method can be achieved.

In the embodiment explained the above, reference has been made as to the method of observing the image which is transmitted through the optical fibers (image guide) disposed within the lance from the outside of the coke oven. It is to be understood that a television camera may be used to observe the image at the outside of the coke oven. In this instance the image formed by the lens arranged at the front end of the lance is taken by the television camera and is observed on the monitor television receiver at the outside of the coke oven. It is also to be understood that the image may be recorded or memorized in a videotape or computer so that it may be reproduced to automatically repair the damaged area on wall. More particularly, the damaged area on the wall, its shape and size are recorded in the videotape, computer and the like by conducting the observation of the damages on a predetermined or entire area of the wall. Then, the repairing apparatus is operated automatically based on the information stored in the recording device or apparatus to repair the damages on the wall. In this method, the sequential steps of detecting and repairing the damages on the wall can be effected separately.

In that apparatus shown in FIG. 6, the infrared absorption filter 25 is attached to the rear surface of the window. It is to be understood that the filter 25 may be located between the reflector 34 and the lens 33 or the image guide 32 and the camera 8. Also, the condensing system in the apparatus comprises the reflector, prism, lens and the like which are disposed in the lance individually or disposed in the lance as an assembly. It is to be understood that a total reflection prism may be used instead of using the reflector 35. In the above embodiment, the detecting apparatus is mounted on the special truck. The detecting apparatus may be mounted on a pushing machine, guide car or charging car.

Figure 9:
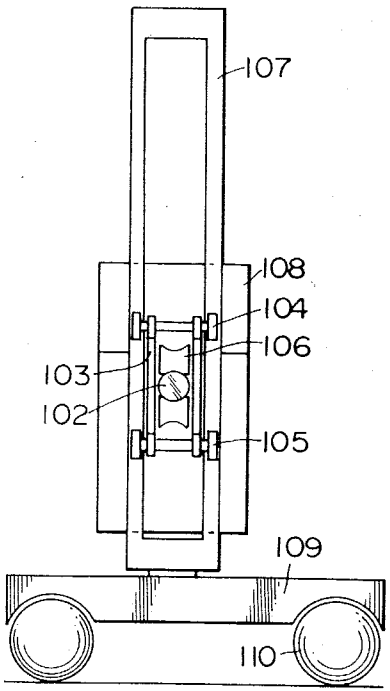
FIG. 9 illustrates a side elevation of the apparatus shown in FIG. 8.
Figure 8:
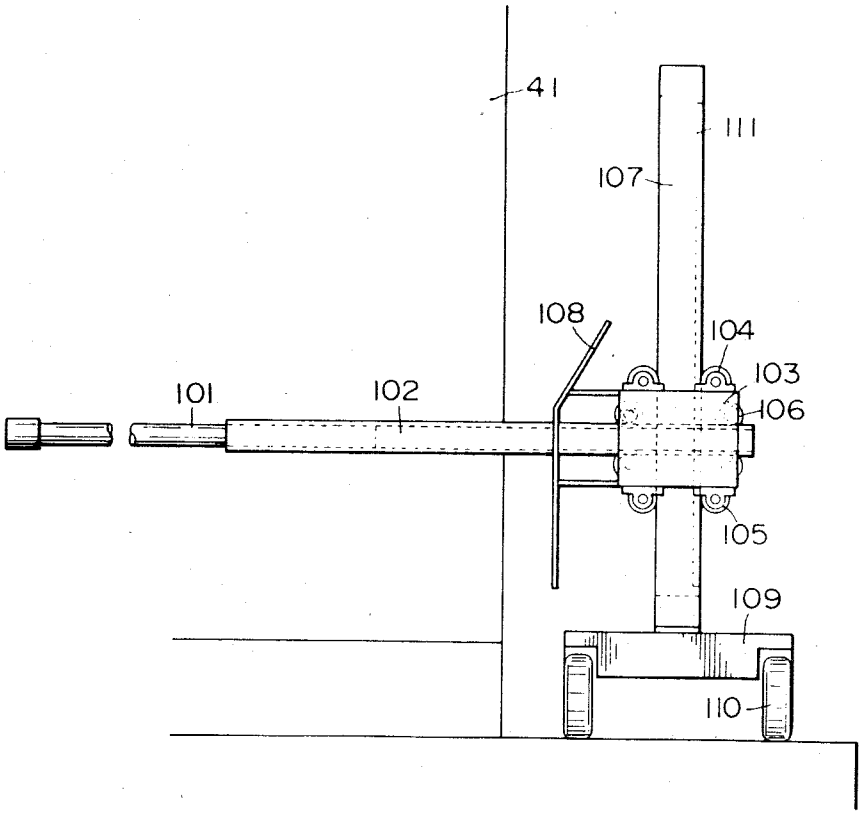
FIG. 8 shows a plan view of the entire apparatus adapted for use according to another embodiment of the present invention.
Figure 10:
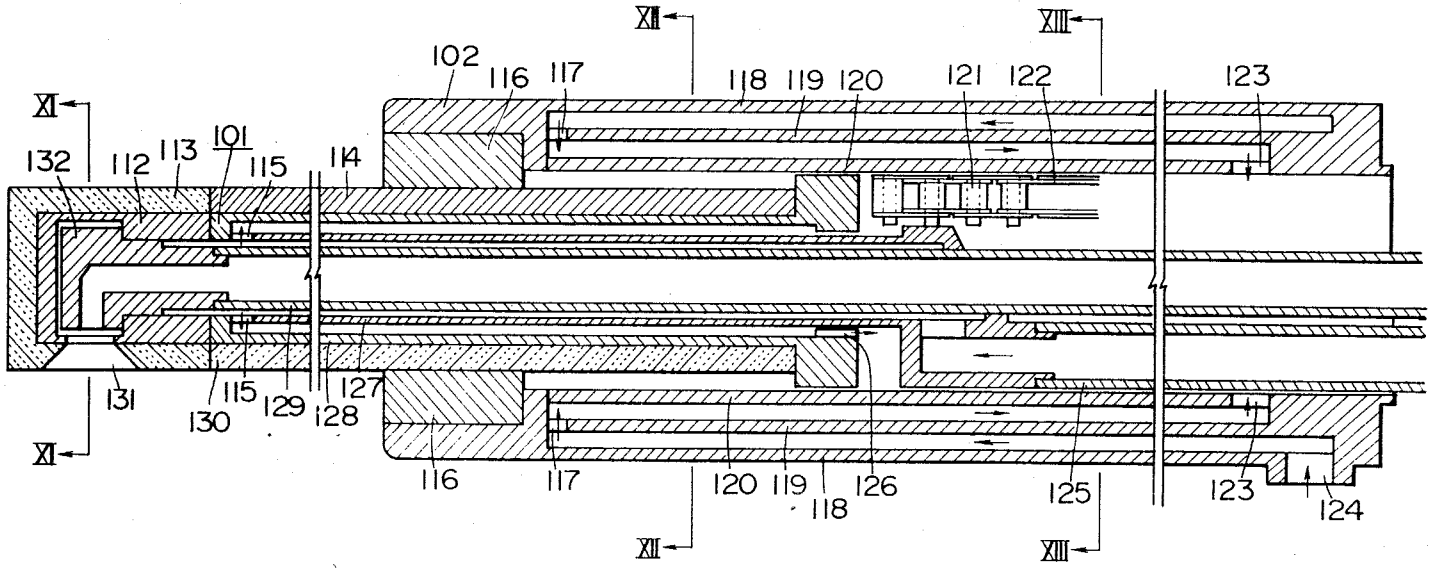
FIG. 10 is an expanded cross-sectional view of a lance portion of the apparatus shown in FIG. 8.
Figure 13:
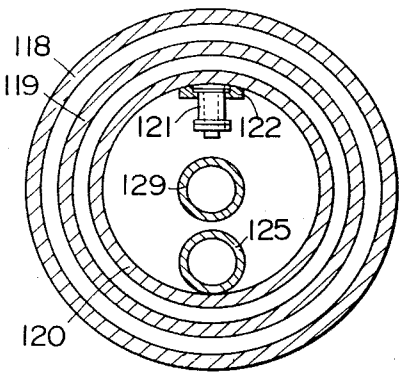
FIG. 13 is a cross-sectional view taken along the lines XIII—XIII of FIG. 10.

Referring to FIGS. 8 through 15, there is shown a modified form of apparatus for observing and/or repairing damages on a wall of the coke oven. The apparatus shown in FIGS. 8 and 9 includes a first lance 101 and a second lance 102 for detecting and/or repairing the damages on the wall. The first lance 101 is telescopically inserted into the second lance 102 so that it may slide into or out of the second lance 102. The second lance 102 is supported by a lance supporting apparatus 103 which gives horizontal and vertical movement to the second lance 102. The second lance 102 is held by four rollers 106 mounted on the lance supporting apparatus 103 which support the second lance 102 horizontally from the upper and lower directions. The second lance 102 is advanced or retracted horizontally by rotating the rollers 106 by any suitable driving means (not shown). The lance supporting apparatus 103 is mounted on a mast 107 rising vertically from a truck 109 by means of gears 104 and rollers 105 which engage with both the front and rear surfaces of the mast 107. The up and down movement of the lance supporting apparatus 103 is effected by rotating the gear 104 by any suitable driving means (not shown) or directly pulling up or down the lance supporting apparatus 103. In FIGS. 8 and 9, reference numeral 108 designates a radiant heat shielding plate and reference numeral 110 designates wheels to move the truck 109.

The inside structure of the first lance 101 and the second lance 102 is as shown in FIGS. 10 through 13. As is apparent from the drawings, the first lance 101 includes an outer conduit 128 and an inner conduit 127 which is disposed coaxially within the outer conduit 128 in a spaced relation therewith. The outer surface of the conduit 128 is covered with a heat insulating material. The second lance 102 includes an outer shell 118, an intermediate conduit 119, and an inner conduit 120 which are disposed coaxially in a spaced relation with each other.

Figure 12:
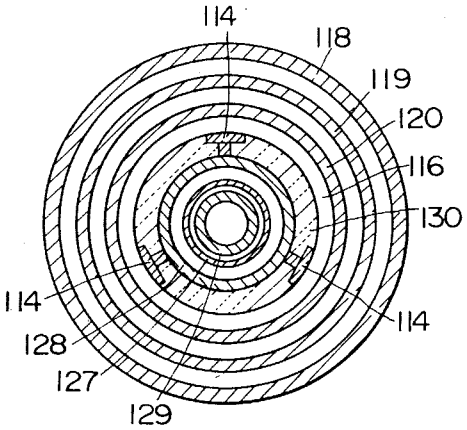
FIG. 12 is a cross-sectional view taken along the lines XII—XII of FIG. 10.
Figure 11:
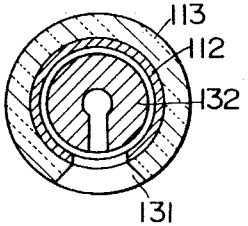
FIG. 11 is a cross-sectional view taken along the lines XI—XI of FIG. 10.

As shown in FIG. 12, the first lance 101 is provided with three guide shoes 114 radially extending from the outer conduit 128 which are to be supported by a ring 116 mounted on the front end of the second lance 102 so that the first lance 101 may slide into or out of the second lance 102. In this manner, the first lance 101 is supported by the second lance 102. The front end of the first lance 101 is provided with a cap 112 having an opening 131 which is detachable and covered with a heat insulating material 113. The cap 112 includes a nozzle 132 for spraying repairing materials having the nozzle orifice directed to the opening 131, which is connected to a hose 129 extending within the first lance 101 and the second lance 102. At the rear end of the first lance 101, there are provided with a hose 125 for supplying cooling liquid and a chain 121 for driving the first lance 101. The chain 121 moves along a chain guide 122 arranged in the longitudinal direction of the second lance 102 when it is driven. Therefore, the first lance 101 slides into the second lance 102 so as to make the entire length of the lance shorter if the chain 121 is pulled by a driving means (not shown). To the contrary, the first lance 101 extends from the second lance 102 so as to make the entire length of the lance longer if the chain is pushed.

The cooling liquid flows lines which are different in the first lance 101 and the second lance 102. As shown by the arrow in FIG. 10, the liquid for cooling the first lance 101 is fed from the hose 125 and circulates through the first lance 101 flowing a channel between the inner conduit 127 and the hose 129, returning to a channel between the inner conduit 127 and the outer conduit 128 through an opening 115 provided at the front end of the lance 101, and being discharged in the second lance 102 from a port 126. The cooling liquid is then discharged outside the cooling liquid supply line from the end of the second lance. The liquid for cooling the second lance 102 is fed from a conduit 124 and circulates through the second lance 102 flowing a channel between the shell 118 and the intermediate conduit 119, returning to a channel between the intermediate 119 and the inner conduit 120 through an opening 117 and being discharged outside the cooling liquid supply line passing through a port 123 and the end of the second lance.

The apparatus shown in FIGS. 8 through 13 can be used for spraying repairing materials only. It may be used in the same manner as explained hereinabove arranging a reflector, an image guide, a nozzle for spraying the repairing materials and the like within the lance as shown in FIG. 6. In a preferable method of using the apparatus, the apparatus is first used as a detecting apparatus by removing the hose 129 and the nozzle 132 from the lance and arranging the optical system, such as, the reflector, the image guide and the like as shown in FIG. 6 in the position of the lance where the hose 129 and the nozzle 132 are removed. If damaged areas on a wall of coke oven are detected, the lance is taken out of the coke oven and the optical system is exchanged with the hose 129 and the nozzle 132. Then, the lance is inserted into the coke oven to have it located at the position where the damages are detected and to spray the repairing material to the damaged area on the wall. In this instance, the front end of the lance can be located at the exact position where the damages are detected if a pulse motor is used as a driving means for the lance.

Figure 15:
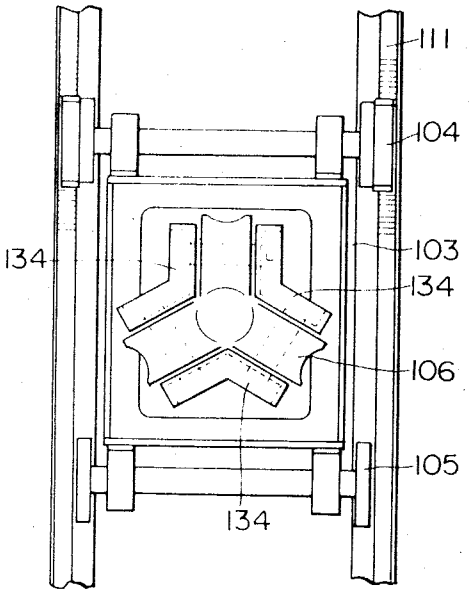
FIG. 15 illustrates a side elevation of the apparatus shown in FIG. 14.
Figure 14:
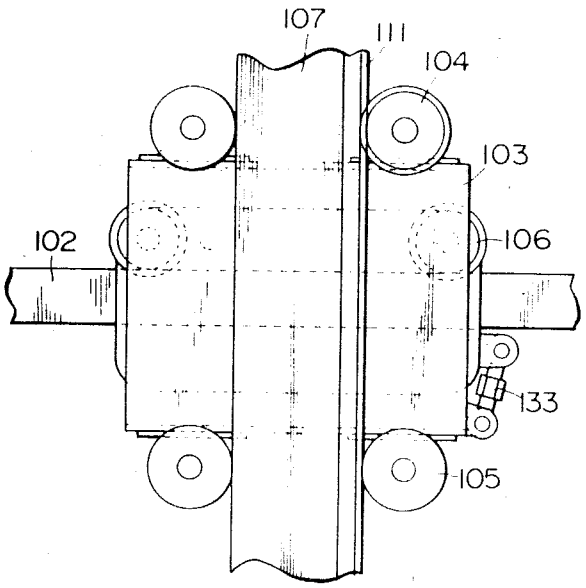
FIG. 14 shows a plan view of a modification of the supporting apparatus for lance according to the present invention.

Referring to FIGS. 14 and 15, there is shown a modified form of lance supporting apparatus 103. In this embodiment, the second lance 102 is horizontally supported by six rollers 106 which are radially disposed in bearings 134 of the lance supporting apparatus 103. The second lance 102 is moved horizontally and vertically in the same manner as the preceding embodiment shown in FIGS. 8 and 9. Reference numeral denotes a jack for regulating angle of the second lance 102 which causes the second lance to incline within a range of approximately 30° either upwardly or downwardly from the horizontal position.

As explained hereinabove, according to the present invention, it is possible to repair the damaged area on the wall while observing the image transmitted through the image guide or taken by the television camera at the outside of the coke oven by means of the optical devices or monitor television receiver. Accordingly, the repairing work can be conducted quickly and reliably not entering into the inside of the coke oven while observing the damaged area on the wall directly at the outside of the coke oven. Therefore, waste of the repairing material can be minimized, and also manual work for repairing the damages on the wall can be saved as compared with the prior art, because the mechanized observation and repair of the damages on the wall can be achieved in the present invention.

Obviously, many modifications and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. A method of repairing damages on a wall of an enclosed chamber in which a fuel is burned to provide heat, which comprises the steps of:

inserting a lance into the inside of the enclosed chamber from a front of the enclosed chamber, said lance being provided with at least an optical system having means for introducing light into said chamber, as well as means for reflecting, focussing and transmitting an image on the wall so as to permit observation at a position outside of the enclosed chamber, and a nozzle for spraying materials adapted for use in repairing the damages on the wall;

detecting the damages on the wall by moving the lance and means for introducing light horizontally and vertically within the enclosed chamber along the wall so as to direct light at damaged areas while observing the image on the wall through the optical system at the outside of the enclosed chamber; and spraying repairing materials onto damaged area detected on the wall from the nozzle.

2. A method of repairing damages on a wall of an enclosed chamber as defined in claim 1 wherein the damaged area on the wall is subjected to abrasion prior to the spray of the repairing materials from the nozzle.

3. A method of repairing damages on a wall of an enclosed chamber as defined in claim 2 wherein the abrasion is conducted by blasting fine particulate materials from the nozzle.

4. A method of repairing damages on a wall of an enclosed chamber as defined in claim 3 wherein the fine particulate material is selected from the group consisting of corundum, emery, garnet, quartz sand, spinel, alumina, zirconia, silicon carbide, boron carbide, boron nitride, grit and shot.

5. A method of repairing damages on a wall of an enclosed chamber as defined in claim 3 wherein the fine particulate material is 0.1 to 5 mm in diameter.

6. A method of repairing damages on a wall of an enclosed chamber as defined in claim 3 wherein the fine particulate material is sprayed under the pressure of 2 to 20 $kg/cm^2.G$.

7. A method of repairing damages on a wall of an enclosed chamber as defined in claim 1 wherein the repairing material is sprayed together with water.

8. A method of repairing damages on a wall of an enclosed chamber as defined in claim 1 wherein the repairing material is sprayed together with air.

9. A method of repairing damages on a wall of an enclosed chamber as defined in claim 1 wherein the repairing material is sprayed together with carrier gas under molten state.

10. A method of repairing damages on a wall of an enclosed chamber as defined in claim 1 wherein said step of detecting the damages on the wall is effected by blowing a gas including oxygen onto the wall.

11. The method of claim 10 wherein said gas including oxygen comprises air.

12. A method of repairing damages on a wall of an enclosed chamber in which a fuel is burned to provide heat, which comprises the steps of:

inserting a lance into the inside of the enclosed chamber from a front of the enclosed chamber, said lance being provided with at least an optical system having means for introducing light into said chamber, as well as means for reflecting, focussing and transmitting an image on the wall so as to permit observation at a position outside of the enclosed chamber and a nozzle for spraying materials adapted for use in repairing the damages on the wall;

detecting the damages on the wall by moving the lance and means for introducing light horizontally and vertically within the enclosed chamber along a predetermined area of the wall so as to direct light on damaged areas while observing the image on the wall through the optical system at the outside of the enclosed chamber;

recording the location of the damaged portion of the wall, the shape and the size of the damaged portion of the wall in a recording device;

moving the lance so as to automatically trace the damaged area detected on the wall based on information stored in the magnetic recording device; and spraying repairing materials onto the damaged areas detected on the wall from the nozzle.

13. A method of repairing damages on a wall of an enclosed chamber as defined in claim 8 wherein said step of detecting the damages on the wall is effected by blowing a gas including oxygen onto the wall.

14. The method of claim 13 wherein said gas including oxygen comprises air.

* * * * *